US010534287B2

(12) United States Patent
Kikuchi

(10) Patent No.: US 10,534,287 B2
(45) Date of Patent: Jan. 14, 2020

(54) IMAGE FORMING APPARATUS, DEVELOPING DEVICE, AND SUPPORT MEMBERS

(71) Applicant: FUJI XEROX CO., LTD., Tokyo (JP)

(72) Inventor: Mutsumi Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/810,143

(22) Filed: Nov. 13, 2017

(65) Prior Publication Data

US 2018/0253026 A1 Sep. 6, 2018

(30) Foreign Application Priority Data

Mar. 6, 2017 (JP) ..... 2017-041412

(51) Int. Cl.
*G03G 15/08* (2006.01)
*G03G 15/00* (2006.01)
*G03G 15/16* (2006.01)

(52) U.S. Cl.
CPC ..... *G03G 15/0813* (2013.01); *G03G 15/1605* (2013.01); *G03G 15/5029* (2013.01)

(58) Field of Classification Search
None
See application file for complete search history.

(56) References Cited

U.S. PATENT DOCUMENTS

| | | | | |
|---|---|---|---|---|
| 5,097,294 | A * | 3/1992 | Nishio | G03G 15/0812 399/284 |
| 6,775,506 | B2 * | 8/2004 | Endoh | G03G 15/0812 399/274 |
| 7,209,685 | B2 * | 4/2007 | Oyama | G03G 15/0875 399/254 |
| 8,909,110 | B2 * | 12/2014 | Nishida | G03G 15/0812 399/284 |
| 9,025,998 | B2 * | 5/2015 | Morioka | G03G 21/1821 399/111 |
| 2013/0164028 | A1 * | 6/2013 | Morioka | G03G 21/1821 399/111 |
| 2013/0322932 | A1 * | 12/2013 | Nishida | G03G 15/0812 399/284 |

FOREIGN PATENT DOCUMENTS

| | | |
|---|---|---|
| AU | 2007201595 | 11/2007 |
| JP | 2005266447 | 9/2005 |
| JP | 2007304142 | 11/2007 |

* cited by examiner

*Primary Examiner* — Victor Verbitsky
(74) *Attorney, Agent, or Firm* — JCIPRNET

(57) ABSTRACT

An image forming apparatus includes an image carrier that carries a latent image, a developer holder that holds developer for developing the latent image carried by the image carrier, and a layer-thickness restriction member that restricts the layer thickness of the developer held by the developer holder. When the developer holder approaches the layer-thickness restriction member, the layer-thickness restriction member moves away from the developer holder and then toward the developer holder.

9 Claims, 7 Drawing Sheets

IMAGE FORMING APPARATUS, DEVELOPING DEVICE, AND SUPPORT MEMBERS

CROSS-REFERENCE TO RELATED APPLICATIONS

This application is based on and claims priority under 35 USC 119 from Japanese Patent Application No. 2017-041412 filed Mar. 6, 2017.

BACKGROUND

Technical Field

The present invention relates to an image forming apparatus, a developing device, and support members.

SUMMARY

According to an aspect of the invention, there is provided an image forming apparatus including: an image carrier that carries a latent image; a developer holder that holds developer for developing the latent image carried by the image carrier; and a layer-thickness restriction member that restricts the layer thickness of the developer held by the developer holder. When the developer holder approaches the layer-thickness restriction member, the layer-thickness restriction member moves away from the developer holder and then toward the developer holder.

BRIEF DESCRIPTION OF THE DRAWINGS

Exemplary embodiment of the present invention will be described in detail based on the following figure, wherein.

DETAILED DESCRIPTION

Figure 1:
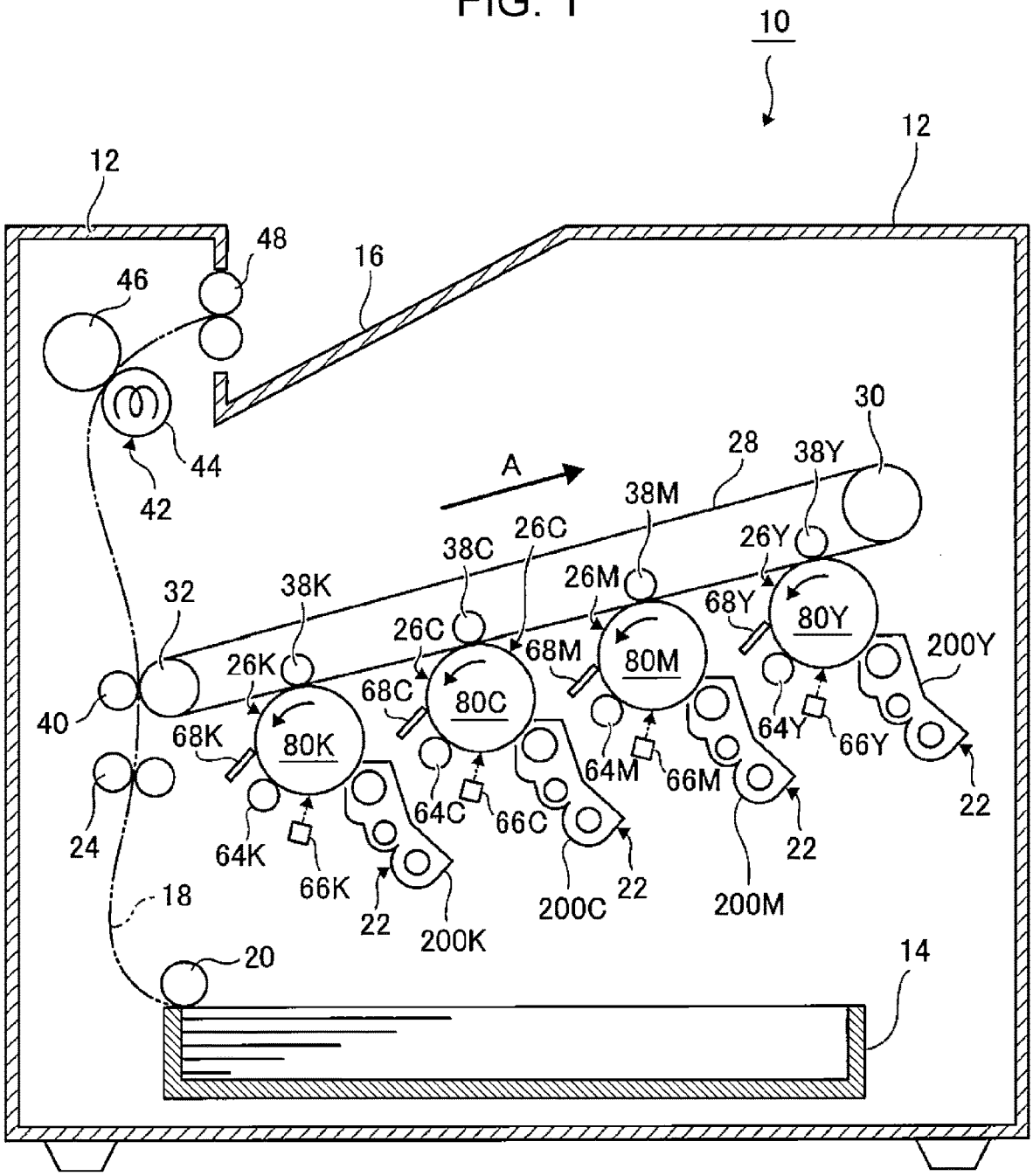
FIG. 1 is a sectional view, as viewed from the front side, of an image forming apparatus according to an exemplary embodiment of the present invention.

An exemplary embodiment of the present invention will be described in detail below with reference to the drawings. FIG. 1 is a sectional view, as viewed from the front side, showing the configuration of an image forming apparatus 10 according to an exemplary embodiment of the present invention.

The image forming apparatus 10 includes an image forming apparatus body 12. The image forming apparatus body 12 accommodates, at the lower part thereof, a sheet storage unit 14. The image forming apparatus body 12 has, at the upper part thereof, a sheet output part 16. The sheet storage unit 14 accommodates multiple sheets. A sheet transport path 18 extending from the sheet storage unit 14 to the sheet output part 16 is formed inside the image forming apparatus body 12.

The top sheet of the sheets stored in the sheet storage unit 14 is fed out by a pickup roller 20. The sheet fed out by the pickup roller 20 is temporarily stopped by registration rollers 24 for positioning and is then transported toward a second transfer roller 40 (described below) at predetermined timing.

The image forming apparatus body 12 accommodates, in the middle thereof, image forming units 22. The image forming units 22 include, for example, four image forming units 26Y, 26M, 26C, and 26K. The image forming units 26Y, 26M, 26C, and 26K correspond to yellow (Y), magenta (M), cyan (C), and black (K), respectively, and are arranged along an intermediate transfer belt 28 at certain intervals. The intermediate transfer belt 28 is supported by, for example, two support rollers 30 and 32 and revolves in an arrow A direction.

The image forming units 26Y, 26M, 26C, and 26K include: photoconductor drums 80Y, 80M, 80C, and 80K, serving as image carriers; charging devices 64Y, 64M, 64C, and 64K; latent-image forming devices 66Y, 66M, 66C, and 66K; developing devices 200Y, 200M, 200C, and 200K; and cleaning devices 68Y, 68M, 68C, and 68K. The details of the developing devices 200Y, 200M, 200C, and 200K will be described below.

Because the charging devices 64Y, 64M, 64C, and 64K have the same configuration, they will be collectively called charging devices 64 in the description below where they do not need to be distinguished from one another. The latent-image forming devices 66Y, 66M, 66C, and 66K will also be collectively called latent-image fainting devices 66 in the description below where they do not need to be distinguished from one another. The developing devices 200Y, 200M, 200C, and 200K will also be collectively called the developing devices 200 in the description below where they do not need to be distinguished from one another. The cleaning devices 68Y, 68M, 68C, and 68K will also be collectively called the cleaning devices 68 in the description below where they do not need to be distinguished from one another. The image forming units 26Y, 26M, 26C, and 26K will also be collectively called the image forming units 26 in the description below where they do not need to be distinguished from one another.

The photoconductor drums 80Y, 80M, 80C, and 80K are opposed to first transfer rollers 38Y, 38M, 38C, and 38K with the intermediate transfer belt 28 therebetween. Developer images formed in the image forming units 26Y, 26M, 26C, and 26K are first-transferred to the intermediate transfer belt 28 by the first transfer rollers 38Y, 38M, 38C, and 38K. Because the first transfer rollers 38Y, 38M, 38C, and 38K have the same configuration, they will be collectively called the first transfer rollers 38 in the description below where they do not need to be distinguished from one another.

The second transfer roller 40 is opposed to the support roller 32 with the intermediate transfer belt 28 therebetween. The first-transferred toner images are second-transferred, by the second transfer roller 40, to a sheet transported along the sheet transport path 18.

The sheet to which the toner images are second-transferred is transported to a fixing device 42. The fixing device 42 fixes, to the sheet, the toner images transferred to the sheet by using, for example, heat and pressure and includes, for example, a heating roller 44 and a pressure roller 46. The sheet to which the toner images have been fixed by the fixing device 42 is discharged to the sheet output part 16 by discharging rollers 48.

Figure 2:
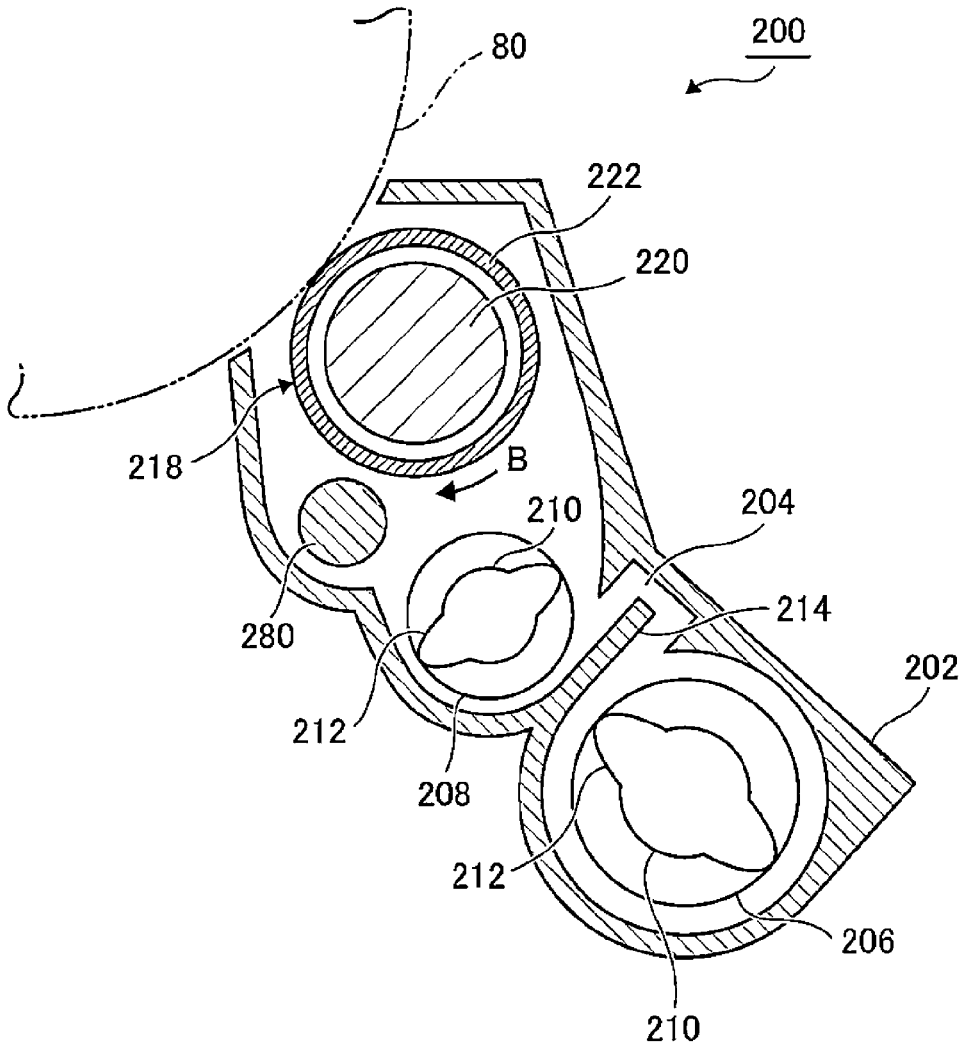
FIG. 2 is a sectional view, as viewed from the front side, of a developing device of the image forming apparatus shown in FIG. 1.

FIG. 2 shows a developing device 200. The developing device 200 is a two-component developing device that develops images with developer containing, at least, toner and carrier. The developing device 200 includes a developing device body 202. A developer circulating path 204 is formed inside the developing device body 202. Furthermore, a first developer transport member 206 and a second developer transport member 208 are disposed inside the developer circulating path 204.

The first developer transport member 206 and the second transport member 208 each have a rotation shaft 210 and a spiral stirring-and-transporting part 212 that is formed on the circumference of the rotation shaft 210. Furthermore, the first developer transport member 206 and the second developer transport member 208 are partitioned by a partition wall 214. The longitudinal ends of the partition wall 214 are provided with openings (not shown) that allow the developer to circulate in the developer circulating path 204.

The developing device 200 further includes a developing roller 218. The developing roller 218 is disposed so as to oppose the photoconductor drum 80 and includes a cylindrical magnet member 220 and a developing sleeve 222. The developing sleeve 222 is used as a developer holder that holds developer for developing a latent image held on the photoconductor drum 80. The developing sleeve 222 has a cylindrical shape covering the magnet member 220 and rotates in an arrow B direction, as shown in FIG. 2, while being supported by the magnet member 220.

The developing device 200 further includes a layer-thickness restriction member 280. The layer-thickness restriction member 280 is disposed so as to oppose the developing sleeve 222 and restricts the layer thickness of the developer held by the developing sleeve 222. The layer-thickness restriction member 280 has, for example, a cylindrical shape and is disposed so as to form a gap between itself and the developing sleeve 222. The layer-thickness restriction member 280 restricts the layer thickness of the developer held by the developing sleeve 222 such that it scrapes off the developer (magnetic brush) that cannot pass through the gap from the surface of the developing sleeve 222.

Figure 3:
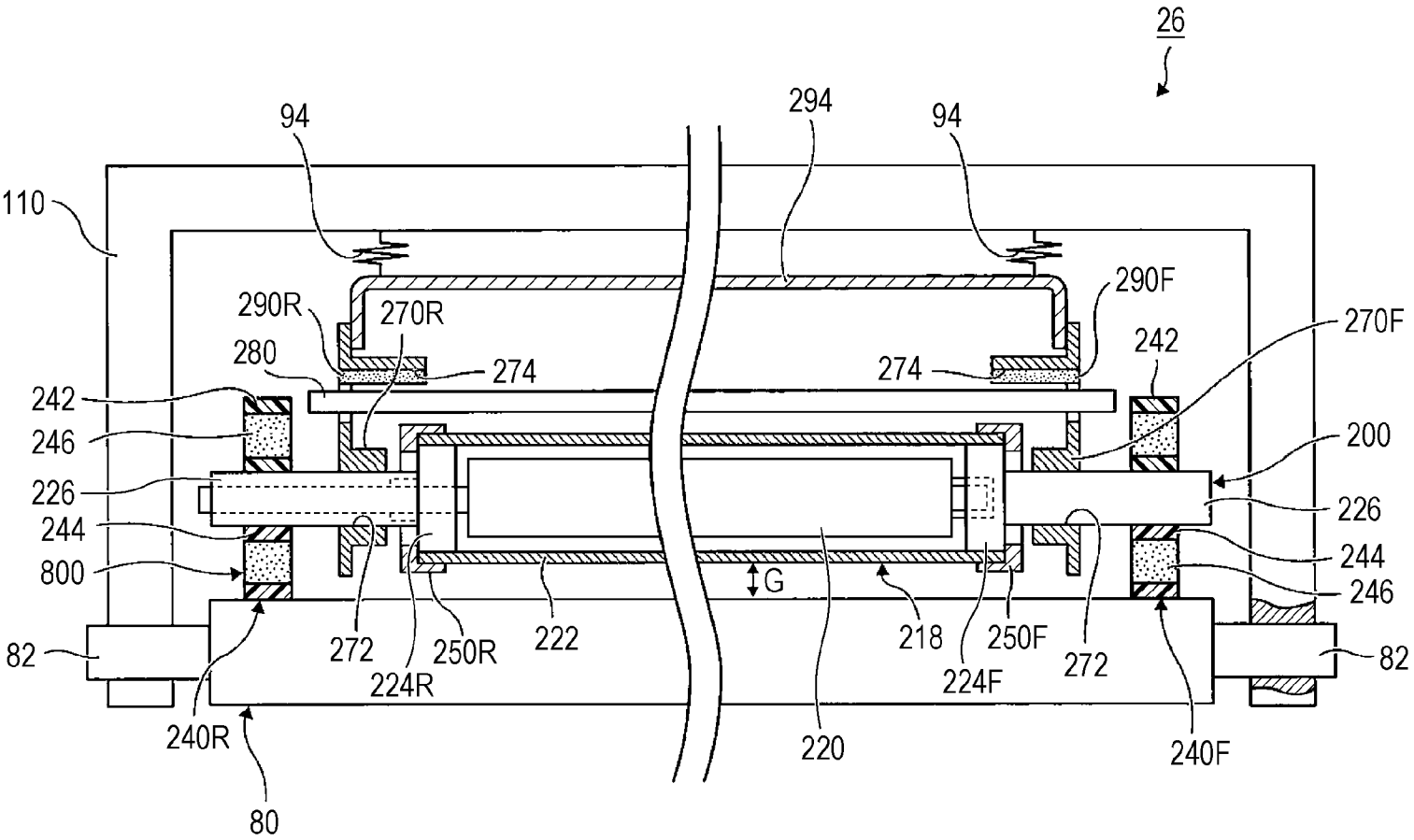
FIG. 3 schematically shows configurations for supporting an image carrier, a developer holder, and a layer-thickness restriction member of the image forming apparatus in FIG. 1 and shows the positional relationship among the image carrier, the developer holder, and the layer-thickness restriction member.

FIG. 3 schematically shows more detailed configurations of the photoconductor drum 80, the developing roller 218, and the layer-thickness restriction member 280, configurations for supporting the photoconductor drum 80, the developing roller 218, and the layer-thickness restriction member 280, and the positional relationship among the photoconductor drum 80, the developing roller 218, and the layer-thickness restriction member 280. In FIG. 3, the right side corresponds to the front side of the image forming apparatus 10 (in FIG. 1, the near side in the plane of the drawing), and the left side corresponds to the rear side of the image forming apparatus 10 (in FIG. 1, the far side in the plane of the drawing).

As shown in FIG. 3, the developing device 200 includes a support member 270F and a support member 270R, which are disposed on the front side and the rear side, respectively. The support member 270F and the support member 270R will be collectively called the support members 270 in the description below where they do not need to be distinguished from each other. The support members 270 are used as support members for supporting the developing roller 218 and the layer-thickness restriction member 280.

The support members 270 are provided with developing-roller support holes 272 and restriction-member support holes 274. The developing-roller support holes 272 are used to support the developing roller 218 in a rotatable manner. The restriction-member support holes 274 are used as support parts, into which portions of the layer-thickness restriction member 280 are inserted and that support the layer-thickness restriction member 280 in a movable manner. The restriction-member support holes 274 support the layer-thickness restriction member 280 such that it can move toward and away from the developing sleeve 222.

As shown in FIG. 3, the developing device 200 includes a push-back member 290F and a push-back member 290R, which are disposed on the front side and the rear side, respectively. The push-back member 290F and the push-back member 290R will be collectively called the push-back members 290 in the description below where they do not need to be distinguished from each other.

The push-back members 290 are elastic members and may be made of a cushioning material, a rubber material, or a urethane material. More specifically, the push-back members 290 may be made of ether polyurethane, silicone, microcell polymer, or the like. The thickness of the push-back members 290 may be, for example, from 0.3 mm to 1.0 mm, and more preferably, from 0.7 mm to 0.9 mm. The push-back members 290 may be made of a material having a hardness of, for example, 20 to 90, and more preferably, 45 to 75, in hardness measured with a durometer complying with JIS K 6253.

The push-back members 290 that are made of the above-described material are deformed such that the layer-thickness restriction member 280 moves away from the developing sleeve 222 when the surface of the developing sleeve 222 approaches the layer-thickness restriction member 280. Furthermore, the push-back members 290 push back the layer-thickness restriction member 280 toward the developing sleeve 222 as they return to the original state. The push-back members 290 are attached to the inner circumferential surfaces of the restriction-member support holes 274 provided in the support members 270, on the opposite side from the developing sleeve 222 with respect to the layer-thickness restriction member 280.

The developing device 200 further includes a developing-roller support member 294. The support member 270F and the support member 270R are attached to the developing-roller support member 294. Specifically, the developing-roller support member 294 supports the developing roller 218 via the support member 270F and the support member 270R. The developing-roller support member 294, the support member 270F, the support member 270R, and the developing roller 218 integrally move with respect to a drum support member 110.

As shown in FIG. 3, the photoconductor drum 80 includes a drum rotation shaft 82, which is supported by the drum support member 110 in a rotatable manner.

As has been described, the developing roller 218 includes the magnet member 220 (see also FIG. 2), the developing sleeve 222, and a flange member 224F and a flange member 224R that are disposed on the front side and the rear side, respectively. The flange member 224F and the flange member 224R will be collectively called the flange members 224 in the description below where they do not need to be distinguished from each other. The outer portions of the flange members 224 are used as a roller rotation shaft 226.

The front part of the roller rotation shaft 226 is rotatably supported by the developing-roller support hole 272 formed in the support member 270F, and the rear part of the roller rotation shaft 226 is rotatably supported by the developing-roller support hole 272 formed in the support member 270R.

As shown in FIG. 3, the image forming unit 26 further includes, for example, two coil springs 94. The coil springs 94 serve as urging parts that urge the developing sleeve 222 toward the photoconductor drum 80. The ends of the coil springs 94 are attached to the drum support member 110 and to the developing-roller support member 294.

The operations of the layer-thickness restriction member 280 and the push-back members 290 of the thus-configured image forming units 26 will be described in detail below (see FIG. 8).

As shown in FIG. 3, the image forming unit 26 further includes a tracking roller 240F and a tracking roller 240R, which are disposed on the front side and the rear side, respectively. The tracking roller 240F and the tracking roller 240R will be collectively called the tracking rollers 240 in the description below where they do not need to be distinguished from each other.

The tracking rollers 240 are used as restriction parts that restrict at least one of the maximum distance between the photoconductor drum 80 and the developing roller 218 and the minimum distance between the photoconductor drum 80 and the developing roller 218. Furthermore, the tracking rollers 240 are provided coaxially with the developing roller 218 and are rotatably attached to the roller rotation shaft 226. The tracking rollers 240 include outer ring members 242, inner ring members 244, and elastic members 246 (see also FIG. 7).

The outer ring members 242 have a ring shape, and the outer circumferential surfaces thereof are in contact with the photoconductor drum 80.

The inner ring members 244 have a ring shape and support the roller rotation shaft 226 so as to allow rotation thereof. More specifically, the inner ring members 244 are formed of a resin having a low sliding resistance and support, with the inner circumferential surfaces thereof, serving as sliding surfaces, the roller rotation shaft 226 so as to allow rotation thereof. The inner ring members 244 are disposed on the inner side of the outer ring members 242.

The elastic members 246 are fitted between the outer ring members 242 and the inner ring members 244 and are deformed when the distance between the photoconductor drum 80 and the developing roller 218 changes. The elastic members 246 may be made of, for example, a urethane rubber or an elastomer.

The outer ring members 242 and the inner ring members 244 are formed of a resin that is less likely to be elastically deformed than the elastic members 246. The outer ring member 242, the inner ring member 244, and the elastic member 246 may be formed as a single component.

In the thus-configured tracking rollers 240, when one of the outer ring members 242 and the inner ring members 244 are moved while the other of the outer ring members 242 and the inner ring members 244 are fixed, the elastic members 246 are elastically deformed, thus changing the positional relationship between the outer ring members 242 and the inner ring members 244.

As shown in FIG. 3, the image forming unit 26 further includes a tracking cap 250F and a tracking cap 250R, which are disposed on the front side and the rear side, respectively. The tracking cap 250F and the tracking cap 250R will be collectively called the tracking caps 250 in the description below where they do not need to be distinguished from one another.

The tracking caps 250 have a greater outside diameter than the developing roller 218 and a smaller outside diameter than the tracking rollers 240 and are attached to the outer circumferential surface of the developing roller 218. It is desirable that the tracking caps 250 be rotatable relative to the developing roller 218.

In the thus-configured image forming unit 26, the developing-roller support member 294, the developing roller 218, the tracking rollers 240, and the tracking caps 250 are urged, as a single component, toward the photoconductor drum 80 by the coil springs 94, and the outer ring members 242 of the tracking rollers 240 encounter the photoconductor drum 80. Then, at a position where the urging force of the coil springs 94 balances the repulsive force of the elastic members 246 generated due to the deformation thereof, the developing-roller support member 294, the developing roller 218, the tracking rollers 240, and the tracking caps 250 come to rest.

At this time, the elastic members 246 are deformed according to the distance between the photoconductor drum 80 and the developing roller 218. More specifically, when the photoconductor drum 80 and the developing roller 218 approach each other, the outer ring members 242 and the inner ring members 244 approach each other at some positions, and, at these positions, the elastic members 246 are deformed so as to be flattened. Hence, the deformation of the elastic members 246 absorbs the change in the distance between the developing roller 218 and the photoconductor drum 80 (hereinbelow, DRS), and, in this exemplary embodiment, uneven development due to variations in DRS is suppressed.

Meanwhile, because the image forming unit 26 has the elastic members 246, when the elastic members 246 are deteriorated or excessively deformed, DRS may change significantly, which may result in that, at least one of the maximum and minimum values of DRS falls out of the range desired to suppress the intensity unevenness. Hence, the image forming unit 26 has a distance restriction mechanism 800 that restricts the maximum and minimum values of DRS so that DRS is in the predetermined range. The distance restriction mechanism 800 is an example of a distance restriction part.

Although the distance restriction mechanism 800 described below restricts both the maximum and minimum values of DRS, the distance restriction mechanism 800 only needs to restrict at least one of the maximum and minimum values of DRS.

The distance restriction mechanism 800 includes, as a component thereof, the elastic members 246. Specifically, the elastic members 246 of the distance restriction mechanism 800 are provided in the tracking rollers 240. The distance restriction mechanism 800 further includes, as a component thereof, the tracking rollers 240 and the tracking caps 250.

In the distance restriction mechanism 800, when the outer circumferential surfaces of the tracking caps 250 come into contact with the photoconductor drum 80, the developing roller 218 cannot move toward the photoconductor drum 80 any more even if it is urged by the coil springs 94. At this time, the elastic members 246 are pressed by the inner ring members 244 and the outer ring members 242 and are deformed so as to contract.

In this way, the distance restriction mechanism 800 restricts the minimum value of DRS by bringing the tracking caps 250 into contact with the photoconductor drum 80.

As described above, the developing roller 218, the tracking rollers 240, the tracking caps 250, and the developing-roller support member 294 are urged toward the photoconductor drum 80 by the coil springs 94. Hence, even though the tracking caps 250 are separated from the photoconductor drum 80, the tracking rollers 240, which have a greater outside diameter than the tracking caps 250, are pressed against the photoconductor drum 80 at the outer ring members 242. In this state, DRS is maximum. In this way, the distance restriction mechanism 800 restricts the maximum value of DRS by pressing the outer ring members 242 against the photoconductor drum 80.

Figure 4:
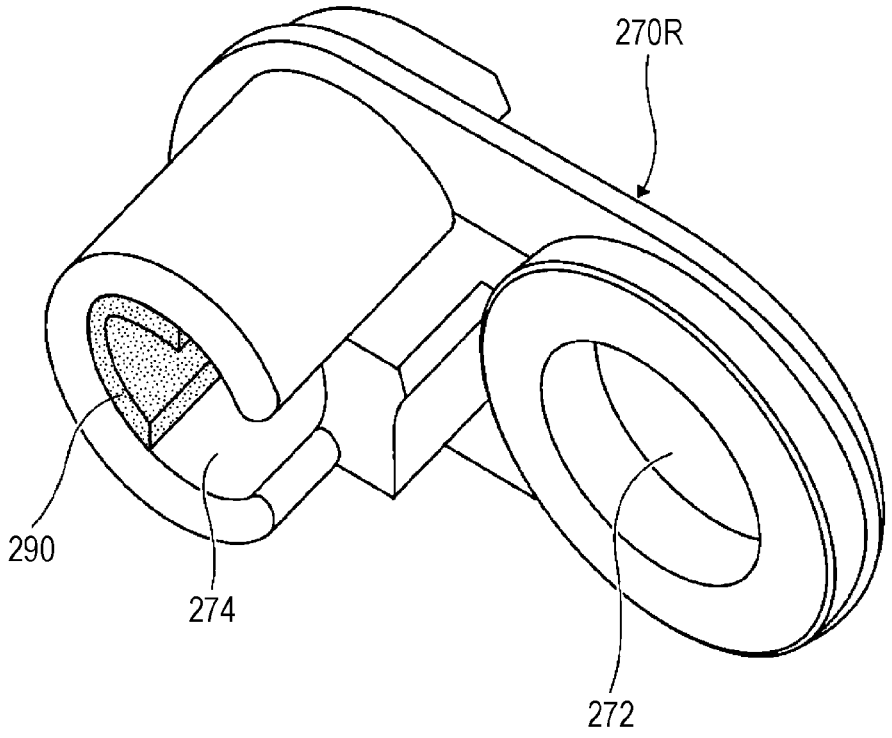
FIG. 4 is a perspective view of a support member that is provided on the rear side in the image forming apparatus shown in FIG. 1.

FIG. 4 is a perspective view of the support member 270R. As described above, the support member 270R has the developing-roller support hole 272 and the restriction-member support hole 274. The push-back member 290 is fitted to the inner circumferential surface of the restriction-member support hole 274, on the opposite side from the developing roller 218 with respect to the layer-thickness restriction member 280.

Figure 5:
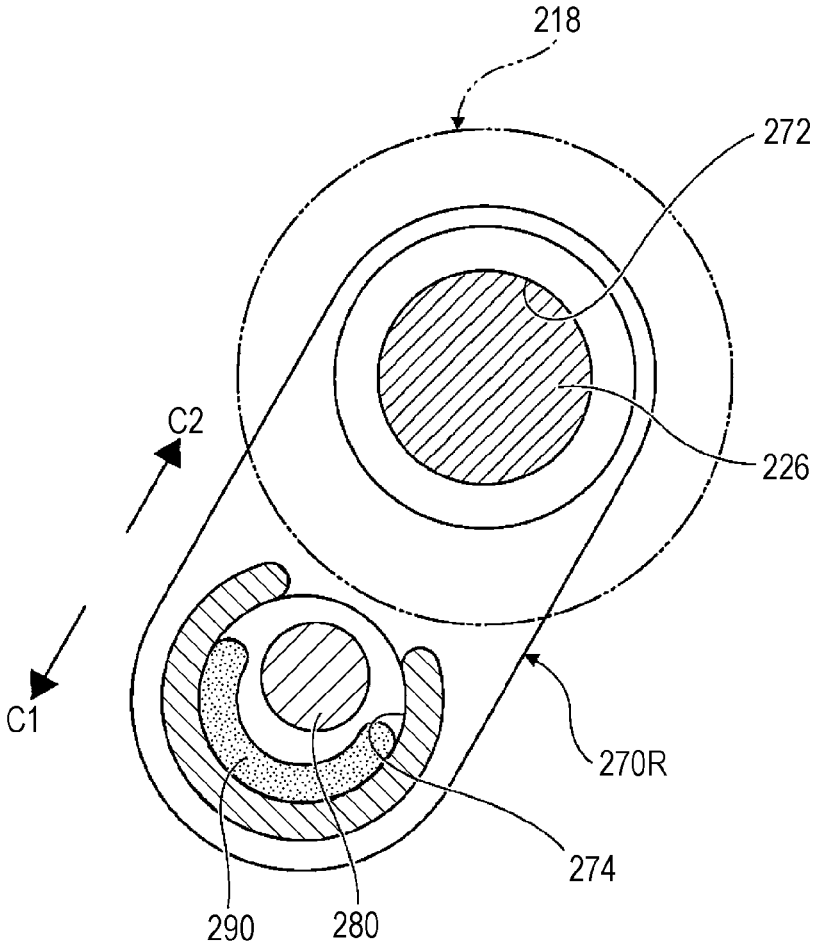
FIG. 5 is a sectional view of the support member shown in FIG. 4 in a state in which the support member is supporting the developer holder and the layer-thickness restriction member.

FIG. 5 is a sectional view showing a state in which the support member 270R supports the developing roller 218 and the layer-thickness restriction member 280. As described above, the roller rotation shaft 226 of the developing roller 218 is inserted into the developing-roller support hole 272, and the developing roller 218 is supported by the support member 270R. Furthermore, the layer-thickness restriction member 280 is inserted into the restriction-member support holes 274, and the layer-thickness restriction member 280 is supported by the support member 270R.

The support member 270R supports the layer-thickness restriction member 280 such that it can move toward and away from the developing roller 218. Specifically, the support member 270R supports the layer-thickness restriction member 280 such that it can move in an arrow C1 direction and an arrow C2 direction.

Figure 6:
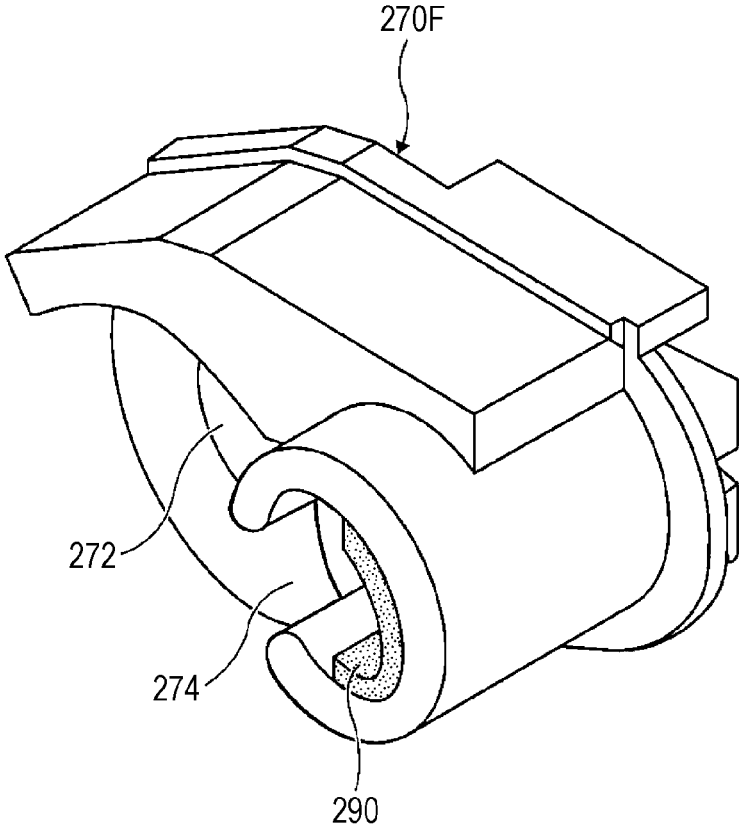
FIG. 6 is a perspective view of a support member that is provided on the front side in the image forming apparatus shown in FIG. 1.

FIG. 6 is a perspective view of the support member 270F. As described above, the support member 270F has the developing-roller support hole 272 and the restriction-member support hole 274. The push-back member 290 is fitted to the inner circumferential surface of the restriction-member support hole 274, on the opposite side from the developing roller 218 with respect to the layer-thickness restriction member 280. Similarly to the support member 270R, the support member 270F also supports the layer-thickness restriction member 280 such that it can move toward and away from the developing roller 218.

Figure 7:
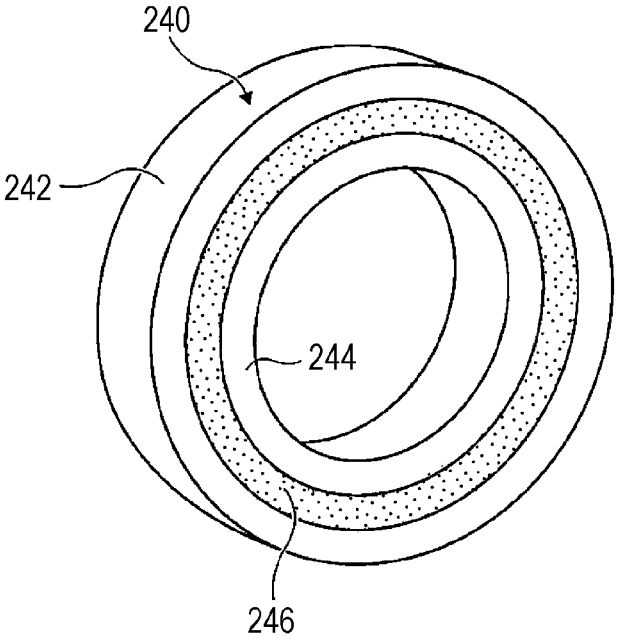
FIG. 7 is a perspective view of a distance restriction member that is provided in the image forming apparatus shown in FIG. 1 and that restricts the distance between the image carrier and the developer holder.

FIG. 7 shows the tracking roller 240. As described above, the tracking roller 240 includes the outer ring member 242, the inner ring member 244, and the elastic member 246.

Figure 8A:
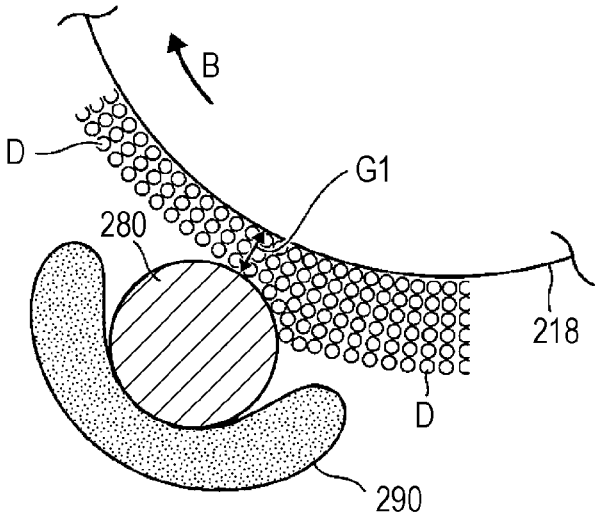
FIGS. 8A to 8C show the movement of the layer-thickness restriction member provided in the image forming apparatus shown in FIG. 1, wherein FIG. 8A schematically shows the movement when the layer thickness of the developer held by the developing roller is restricted, FIG. 8B schematically shows the movement when the layer-thickness restriction member moves away from the surface of the developer holder, and FIG. 8C schematically shows the movement when the layer-thickness restriction member is pushed back by a push-back member.
Figure 8B:
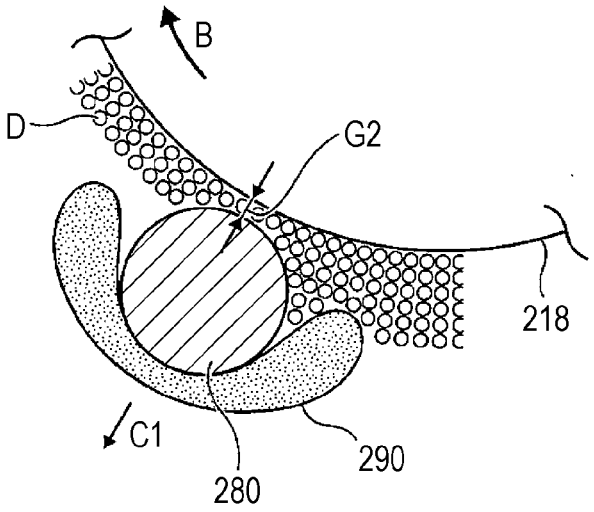
Figure 8C:
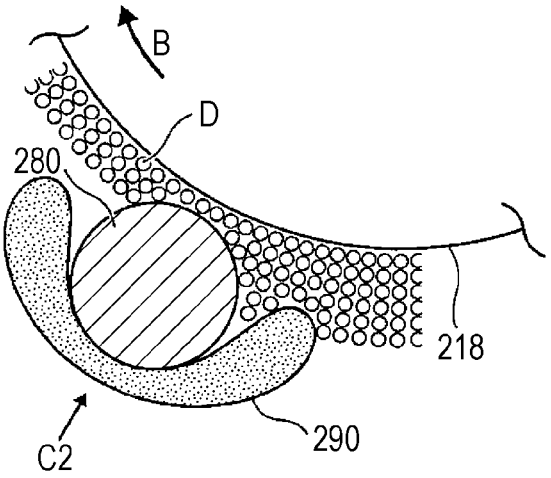

FIGS. 8A to 8C schematically show the movement of the layer-thickness restriction member 280. As shown in FIG. 8A, the layer-thickness restriction member 280 is disposed so as to form a gap G1 between itself and the surface of the developing roller 218. Hence, when the developing roller 218 rotates in the arrow B direction, the two-component developer D that is held on the surface of the developing roller 218 and that cannot pass through the gap G1 is scraped off by the layer-thickness restriction member 280 and is removed from the surface of the developing roller 218. As a result of the two-component developer D being scraped off, the layer thickness of the developer on the downstream side of the gap G1 in the rotation direction of the developing roller 218 is restricted to the thickness of the gap G1.

For example, as shown in FIG. 8B, due to non-uniformity of the diameter of the developing roller 218, the surface of the developing roller 218 may approach the layer-thickness restriction member 280, making the gap between the developing roller 218 and the restriction member narrower (i.e., a gap G2) than the gap G1. In such a case, the layer-thickness restriction member 280 is pushed by the two-component developer (brush, magnetic brush), and the layer-thickness restriction member 280 moves away from the surface of the developing roller 218 in an arrow C1 direction. Thus, in this exemplary embodiment, compared with a technique in which the positional relationship between the developing roller 218 and the layer-thickness restriction member 280 is fixed, the gap G is less likely to be narrowed even when the surface of the developing roller 218 approaches the layer-thickness restriction member 280.

When the layer-thickness restriction member 280 moves in the arrow C1 direction, the push-back members 290 are pressed by the layer-thickness restriction member 280 and are deformed so as to be compressed. For example, in a state in which the push-back members 290 are compressed, when the surface of the developing roller 218 moves away from the layer-thickness restriction member 280 due to non-uniformity of the diameter of the developing roller 218, the push-back members 290, which are elastic members, are restored from the deformed state. As shown in FIG. 8C, when the push-back members 290 are restored from the deformed state, the push-back members 290 push back the layer-thickness restriction member 280 toward the developing roller 218, as shown by an arrow C2.

In this way, in this exemplary embodiment, even when the surface of the developing roller 218 moves away from the layer-thickness restriction member 280, the gap G is less likely to increase than in a technique in which the positional relationship between the developing roller 218 and the layer-thickness restriction member 280 is fixed.

As shown in FIGS. 8A, 8B, and 8C, the push-back members 290 are in surface contact with the layer-thickness restriction member 280 at least in an elastically deformed state.

As has been described above, the push-back members 290 are used as push-back members that are deformed such that the layer-thickness restriction member 280 moves away from the developing sleeve 222 when the surface of the developing sleeve 222 approaches the layer-thickness restriction member 280 and then push back the layer-thickness restriction member 280 toward the developing sleeve 222 as they are restored from the deformed state. The push-back members 290 are also used as elastic members that are in contact with portions of the layer-thickness restriction member 280 opposite from the developing sleeve 222, and that are pushed by the layer-thickness restriction member 280 and elastically deformed when the layer-thickness restriction member 280 moves away from the surface of the developing sleeve 222.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a latent image;

support members, each has a first support hole and a second support hole;

a developer holder that holds developer for developing the latent image carried by the image carrier, and includes two opposite ends respectively being disposed in the first support hole of the support members at each of the two opposite ends of the developer holder; and a layer-thickness restriction member that includes two opposite ends respectively being disposed in the second support hole of the support member at each of the two opposite ends of the layer-thickness restriction member, and restricts the layer thickness of the developer held by the developer holder, wherein, when the developer holder approaches the layer-thickness restriction member, the entire layer-thickness restriction member moves away from the developer holder and then toward the developer holder.

2. The image forming apparatus according to claim 1, further comprising support members that support the developer holder and the layer-thickness restriction member, wherein the support members support the layer-thickness restriction member such that the layer-thickness restriction member can move toward and away from the developer holder.

3. The image forming apparatus according to claim 2, further comprising push-back members that are deformed such that the layer-thickness restriction member moves away from the developer holder when the developer holder approaches the layer-thickness restriction member and then push back the layer-thickness restriction member toward the developer holder as the push-back members are restored from a deformed state, wherein the support members have support parts into which portions of the layer-thickness restriction member are inserted and that support the layer-thickness restriction member in a movable manner, and the push-back members are attached to portions of the support parts opposite from the developer holder with respect to the layer-thickness restriction member.

4. The image forming apparatus according to claim 1, further comprising:

urging parts that bring the image carrier and the developer holder toward each other; and distance restriction parts having elastic members that are deformed when the distance between the image carrier and the developer holder changes, thus restricting at least one of the maximum distance and the minimum distance between the image carrier and the developer holder such that the distance therebetween is within a predetermined range.

5. The image forming apparatus according to claim 4, wherein the distance restriction parts have distance restriction members that are provided coaxially with the developer holder and are in contact with the image carrier to restrict the distance between the image carrier and the developer holder, and the elastic members are provided on the distance restriction members.

6. The image forming apparatus according to claim 5, wherein the distance restriction members include outer ring members that are in contact with the image carrier, and inner ring members that support the developer holder and are disposed on the inner side of the outer ring members, and the elastic members are attached between the outer ring members and the inner ring members.

7. An image forming apparatus comprising:

an image carrier that carries a latent image;

a developer holder that holds developer for developing a latent image held by the image carrier;

a layer-thickness restriction member that includes two opposite ends at which the layer-thickness restriction member being mounted and restricts the layer thickness of the developer held by the developer holder;

support members, each includes a first support hole and a second support hole, that support the layer-thickness restriction member at two opposite ends of the layer-thickness restriction member by the first support hole and the developer holder by the second support hole, such that the layer-thickness restriction member can move toward and away from the developer holder with respect to the two opposite ends at which the layer-thickness restriction member is being supported; and push-back members that are disposed between the support members and the layer-thickness restriction member in the second support hole and deformed such that the entire layer-thickness restriction member moves away from the developer holder when the developer holder approaches the layer-thickness restriction member and then push back the entire layer-thickness restriction member toward the developer holder as the push-back members are restored from a deformed state.

8. The image forming apparatus according to claim 7, wherein the push-back members are in surface contact with the layer-thickness restriction member at least in a deformed state.

9. An image forming apparatus comprising:

an image carrier that carries a latent image;

a developer holder that holds developer for developing the latent image carried by the image carrier; and a layer-thickness restriction member that restricts the layer thickness of the developer held by the developer holder, wherein, when an axial center of the developer holder moves toward to an axial center of the layer-thickness restriction member, the axial center of the layer-thickness restriction member moves in a direction away from the axial center of the developer holder and then moves in a direction toward the axial center of the developer holder, wherein the developing holder and the layer-thickness restriction member have a cylindrical shape.

* * * * *